US006525450B2

(12) United States Patent
Nakamura et al.

(10) Patent No.: US 6,525,450 B2
(45) Date of Patent: Feb. 25, 2003

(54) BULB APPLIED WITH A GLARE PROTECTION PAINT AND A VEHICULAR LIGHTING FIXTURE EQUIPPED THEREWITH

(75) Inventors: Koichi Nakamura, Shizuoka (JP); Kiyoshi Yazaki, Shizuoka (JP); Mitsuhiro Okano, Shizuoka (JP); Hitoshi Hemmi, Tokyo (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 34 days.

(21) Appl. No.: 09/737,495

(22) Filed: Dec. 14, 2000

(65) Prior Publication Data

US 2001/0004319 A1 Jun. 21, 2001

(30) Foreign Application Priority Data

Dec. 14, 1999 (JP) ..... 11-354036

(51) Int. Cl.[7] ..... H01J 5/16

(52) U.S. Cl. ..... 313/110; 313/635; 106/20 C

(58) Field of Search ..... 313/110, 635, 313/637, 112, 116, 117, 478, 479, 480; 106/20 C, 20 D; 362/255

(56) References Cited

U.S. PATENT DOCUMENTS

| | | | | | |
|---|---|---|---|---|---|
| 5,394,050 | A | * | 2/1995 | Aoyama | 313/112 |
| 5,421,877 | A | * | 6/1995 | Hayakawa et al. | 106/453 |
| 5,641,224 | A | | 6/1997 | Makita et al. | |
| 5,734,227 | A | | 3/1998 | Gotoh | |
| 6,129,980 | A | * | 10/2000 | Tsukada et al. | 313/479 |

* cited by examiner

*Primary Examiner*—Vip Patel
*Assistant Examiner*—Joseph Williams
(74) *Attorney, Agent, or Firm*—Koda & Androlia

(57) ABSTRACT

A vehicular bulb with its front end coated with a glare-protection paint that contains silicon carbide (SiC) as its pigment substance. With this silicon carbide contained paint, the front end externally assumes a color that is substantially the same color as reflectors and is thus prevented from being easily recognized from the outside of a lighting fixture that is installed with such a bulb.

10 Claims, 6 Drawing Sheets

FIG. 4

| Paint substances | Ratio of composition (weight %) | |
|---|---|---|
| | Type I | Type II |
| Silicon carbide (SiC) | 28 | 28 |
| Black calcined pigment A (Cu, Fe, Mn) | 7 | - |
| Black calcined pigment B (only Si) | - | 12 |
| Bentonite (thickening agent) | 3 | 2 |
| Silica-type varnish | 62 | 58 |

BULB APPLIED WITH A GLARE PROTECTION PAINT AND A VEHICULAR LIGHTING FIXTURE EQUIPPED THEREWITH

BACKGROUND OF THE INVENTION

1. Field of the Invention

The present invention relates to a bulb with a glare-protection paint applied thereon and to a vehicular lighting fixture equipped with such a bulb.

2. Prior Art

FIG. 5 shows a conventionally employed glare-protection-paint-applied bulb, and FIG. 6 shows a vehicular lighting fixture provided with a shade that has the glare-protection-paint-applied bulb of FIG. 5.

In this prior art vehicular lighting fixture 100, such as a head lamp, a black glare-protection paint 103 is applied on a top portion 102 (generally referred to as "black top coat") of a glass tube of the bulb (an H4 halogen bulb or the like) 101, and this bulb 101 is disposed in a light chamber 107 of the lighting fixture 100 which is equipped with a non-stepped transparent front lens 106.

The black glare-protection paint 103 is applied on the top portion 102 of the glass tube so as to cut the light beams emitted forwards from the bulb 101 and prevent the light beams from being directly emitted from the bulb 101 to the outside. In other words, with the black glare-protection paint 103, the light from the bulb 101 is reflected by a reflector 104 (a reflecting mirror encapsulating the bulb 101); and since this reflector 104 is installed so as to tilt by an aiming mechanism, the reflected light can be emitted in a predetermined direction.

However, since the black glare-protection paint 103 applied on the bulb 101 is seen through the transparent front lens 106 and recognized as a macula on the reflector 104 that has a gray color by aluminum evaporation treatment, it is aesthetically inappropriate and causes poor external appearance.

Accordingly, a cone-shaped member called a shade 105 is generally disposed in the light chamber 107. The shade 105 covers and hides the front portion of the bulb 101 or the black glare-protection paint 103, and it also forms the light beams emitted from the bulb 101 into a predetermined light distribution pattern. The shade 105 externally assumes a color of the same group as that of the reflector 104, thus avoiding the black glare-protection paint 103 of the bulb from being recognized as a macula.

However, this conventional light bulb has some technical problems.

(1) Because the reflecting surface of a reflector has been improved greatly in recent years, a predetermined light distribution pattern can be formed only by reflectors. In other words, it is not necessary to use a shade. Nevertheless, in the above prior art, so as to prevent visual recognition of the black glare-protection paint 103 from the outside, the shade 105 is employed to cover the paint 103. The lighting fixture 100 is thus structurally complicated and has an increased overall number of parts. This constitutes a factor of increase of the costs.

(2) The conventionally employed black glare-protection paint 103 of inorganic paint Type contains chrome and lead, and chrome and lead would cause an environmental pollution.

(3) In order to ensure that the black glare-protection paint 103 assumes a gray color that is the same group of color as that of the reflector 104, white titanium dioxide is mixed with the black pigment. However, the problem is that thermal discoloration occurs due to a high temperature.

(4) In addition, so as to prevent degradation of the portion coated with the glare-protection paint that would occur over time, there has been an increased demand for excellent glare-protection performance and an improvement in heat resistance, impact resistance and corrosion resistance.

SUMMARY OF THE INVENTION

It is, therefore, an object of the present invention to provide a vehicular bulb that is applied with a glare-protection-paint and to provide a vehicular lighting fixture equipped with such a bulb in which a glare-protection paint of a gray color close to that of the exterior of a reflector is applied on the bulb so that the bulb dispenses with a shade member, has an excellent glare-protection performance, high heat resistance, impact resistance and corrosion resistance and is free from the possibility of causing environmental pollution.

So as to accomplish the object, in the glare-protection-paint-applied bulb according to the present invention, the pigment substance of a glare-protection paint that is applied on part of a glass tube contains silicon carbide (SiC).

In this glare-protection paint, since the silicon carbide that is of a white color group is used, it is ensured that the paint assumes a color that is close or similar to a silver color of a reflector. Thus, without a shade, the bulb is not easily visually recognized from the outside, and it can reduce the number of parts and cut down the costs.

Silicon carbide has a crystal structure in which silicon and carbon are covalently linked at a ratio of 1:1. Thus, silicon carbide has hardness and heat resistance that are higher than those of alumina and silicon nitride. Also, it is high in corrosion resistance. Accordingly, discoloration and damages of the glare-protection paint that would be caused by heat from the bulb can be prevented.

Furthermore, in the glare-protection-paint-applied bulb of the present invention, the color of the glare-protection paint is adjusted so that, the glare-protection paint externally assumes a gray color defined by a range of YN-50 to YN-80 defined in JIS (Japanese Industrial Standard) Standard Color Chart (JIS 8721) by compounding a predetermined amount of black calcined pigment (ceramic black) with the pigment substance of the paint.

In this glare-protection-paint-applied bulb, since a predetermined amount of black calcined pigment is compounded with silicon carbide of a white color group, it is possible to achieve harmonization in the form of protective coloration for a silver color of the aluminum-evaporated surface of the reflector disposed around the bulb.

Furthermore, since it is possible to compensate for relatively low glare-protection performance of silicon carbide by the black calcined pigment, color tone and glare-protection performance can be well balanced.

Furthermore, in the glare-protection-paint-applied bulb of the present invention, an inorganic pigment composed of copper (Cu), iron (Fe) and manganese (Mn) is employed as the black calcined pigment.

With the use of this inorganic pigment, organic pigments which are unendurable and fragile in terms of weathering resistance and heat resistance are not used. Also, chrome, lead and the like, which would cause environmental pollution, are not used in the present invention.

In addition, in the glare-protection-paint-applied bulb according to the present invention, an inorganic pigment composed only of silicon (Si) is also employed as the black calcined pigment.

With the use of inorganic pigment composed only of silicon (Si), all metals are eliminated from the inorganic pigment. Accordingly, the present invention is more environment-friendly.

Furthermore, in the glare-protection-paint-applied bulb according to the present invention, the glare-protection paint contains 20 to 30 weight % of silicon carbide.

With the use of this glare-protection paint that contains 20 to 30 weight % of silicon carbide, the glare-protection paint has a desired gray color with sufficient durability and adhesion properties, regardless of the type of black calcined paint used therein.

Furthermore, the present invention provides a vehicular lighting fixture that is equipped with the glare-protection-paint-applied bulb described above.

In this vehicular lighting fixture, it is difficult to visually recognize the bulb inside the light chamber even though a transparent front lens is used. Therefore, this lighting fixture is aesthetically preferable, demonstrates high durability, and causes no problem of environmental pollution in the process of manufacturing and abandoning.

As seen from the above, the glare-protection-paint-applied bulb and the vehicular lighting fixture equipped with such a bulb according to the invention are technically advantageous in that the external appearance of the vehicular lighting fixture is improved, the costs are reduced since no shade is required, and environment-friendliness is enhanced.

BRIEF DESCRIPTION OF THE DRAWINGS

FIG. 4 is a chart showing ratios of composition of paint substances of the glare-protection-paint-applied bulb of the present invention;

DETAILED DESCRIPTION OF THE PREFERRED EMBODIMENTS

Preferred embodiments of the present invention will be described with reference to the accompanying drawings.

Figure 1A:
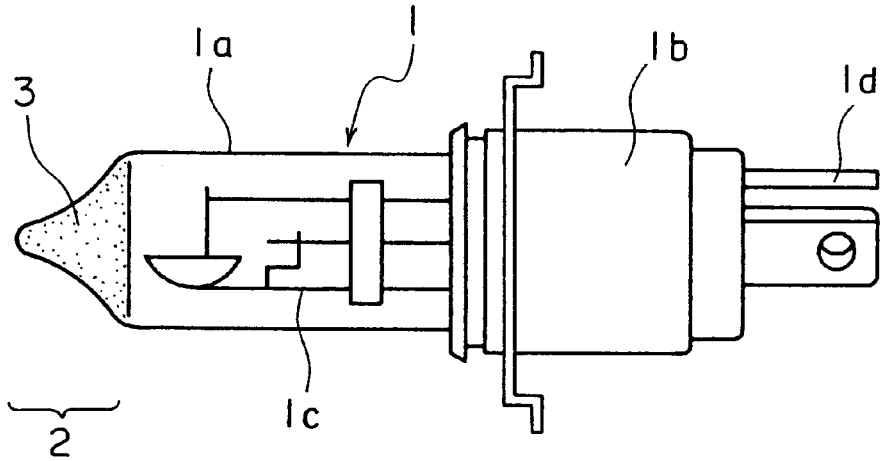
FIG. 1A is a side view of a glare-protection-paint-applied bulb according to one embodiment of the present invention.

In FIG. 1A, a side view, the reference numeral 1 represents a glare-protection-paint-applied bulb according the present invention; and the present invention will be described below with reference to a halogen bulb (H-4 Type) disposed inside a vehicular lighting fixture such as a head lamp for automobiles or autobicycles.

The bulb 1 has an aluminum sealing portion 1*b* to be securely fitted to a lighting fixture. A cylindrical transparent glass tube 1*a* having a generally conically pointed peak portion 2 (hereinafter referred to as "a top portion 2") is extended forwards from the sealing portion 1*b*. A light-emitting member 1*c* such as a filament is disposed inside the glass tube 1*a*. A plate-shape member 1*d* extending behind the sealing portion 1*b* is a feeder terminal to be connected with a power supply.

Figure 1B:
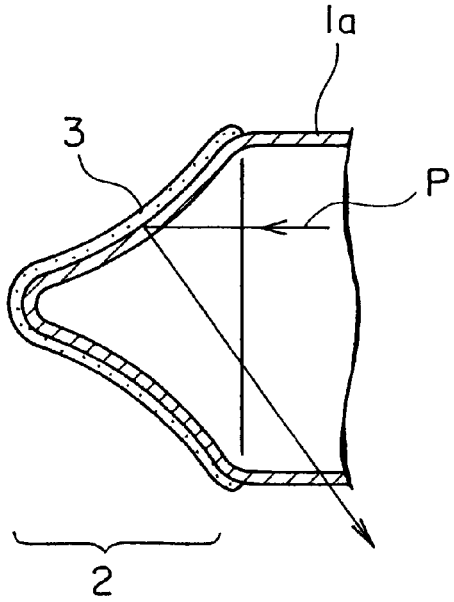
FIG. 1B is a partial cross-sectional view of a top portion of the glare-protection-paint-applied bulb of FIG. 1A.

FIG. 1B is an enlarged cross-sectional view of the top portion 2 of the bulb 1. As shown in FIG. 1B, a glare-protection paint 3 is applied on the surface of the top portion 2. The glare-protection paint 3 is applied on the surface of the top portion 2 for the purpose of preventing light beams of the bulb 1 from being emitted directly to the outside by way of cutting light beams P emitted forwards from the bulb 1, and also for the purpose of obtaining light beams for radiation by way of reflecting backwards the light beams P emitted from the bulb 1 so that they are reflected by a reflector (reflecting mirror) 4 (see FIG. 2) disposed so as to surround the bulb 1.

The structure of a vehicular lighting fixture equipped with the bulb 1 to which the glare-protection paint 3 is applied will be described with reference to FIG. 2.

The vehicular lighting fixture 10 such as a headlamp for automobiles or the like is provided with a reflector 4 inside its lamp body 5. The lamp body 5 is formed of synthetic resin and generally in the shape of a cup. The reflector 4 is tiltably installed by an aiming mechanism (not shown) so that its light-reflecting direction can be adjusted.

The bulb 1 is mounted to a predetermined portion substantially at the center of the reflector 4 in a removable fashion. A non-stepped translucent (transparent) front lens 6 is mounted in the front portion of the lamp body 5 so as to close the opening of a light chamber 7 of the lighting fixture 10.

The reference numeral 8 represents a dummy portion for covering a gap 11 between the reflector 4 and the lamp body 5. The reference numeral 9 represents a cover member for closing a hole 12 that is formed in a rear peak portion of the lamp body 5.

Figure 2:
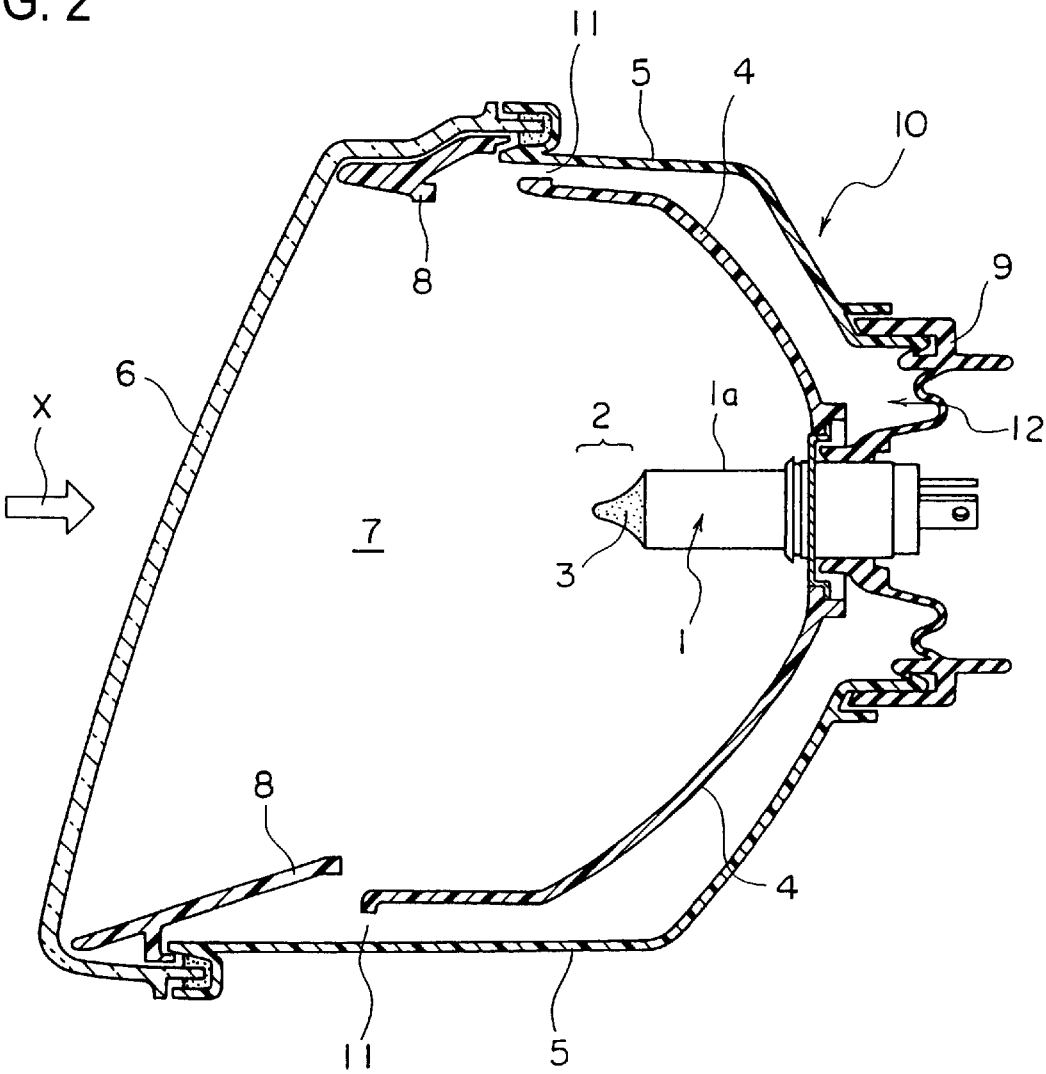
FIG. 2 is a cross-sectional view of one embodiment of a vehicular lighting fixture equipped with the glare-protection-paint-applied bulb of the present invention.
Figure 3:
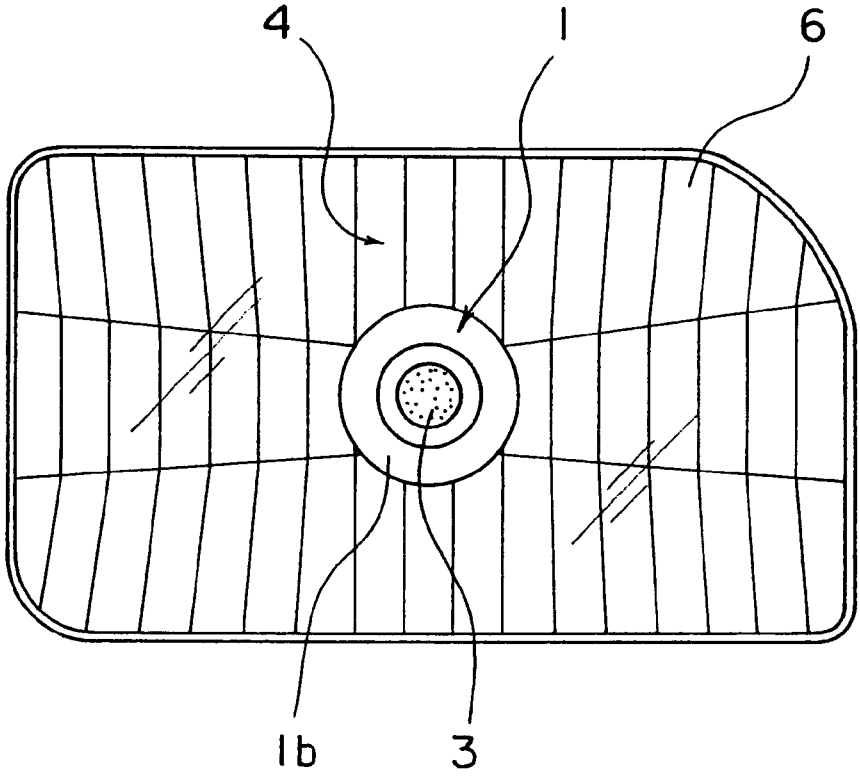
FIG. 3 schematically shows the interior of the light chamber as viewed from the front of the vehicular lighting fixture according to the present invention.
Figure 5:
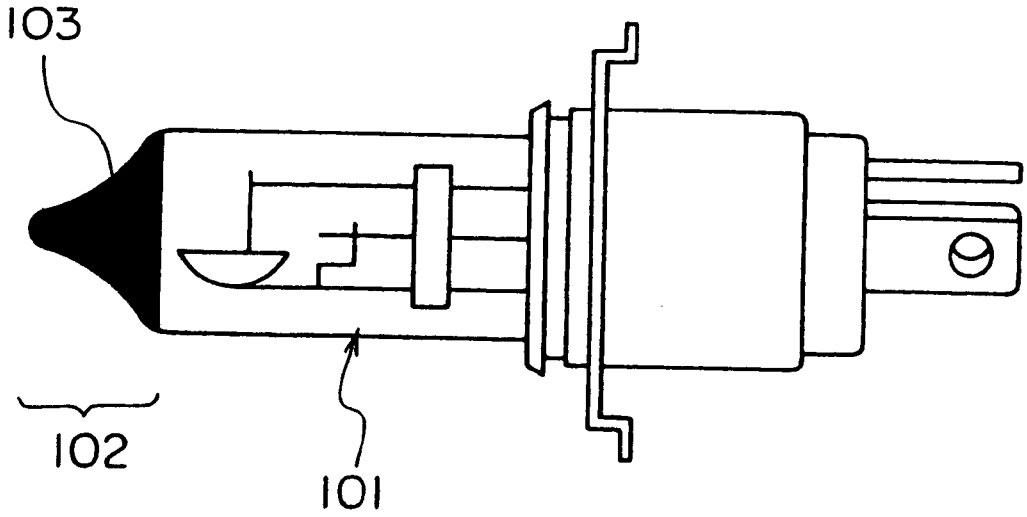
FIG. 5 is a side view of a conventional glare-protection-paint-applied bulb.

FIG. 3 schematically shows the vehicular lighting fixture 10 as viewed from front (in a direction indicated by an arrow X shown in FIG. 2). As seen from FIG. 3, when the vehicular lighting fixture 10 is observed from the outside, the interior of the light chamber 7 can be seen through the front lens 6. To be more specific, the aluminum-evaporated reflector 5 and (the sealing portion 1*b* and the top portion 2 of) the bulb 1 disposed at the center of the reflector 5 can be visually recognized through the transparent front lens 6.

Accordingly, if the reflector 5 has a silver color (a color of aluminum evaporation), and a bulb having a top portion to which a glare-protection paint of another color (e.g. a black color) is applied is installed in such a reflector as in the conventional art, the top portion is visually recognized as a macula. This causes a disadvantage in design.

Figure 6:
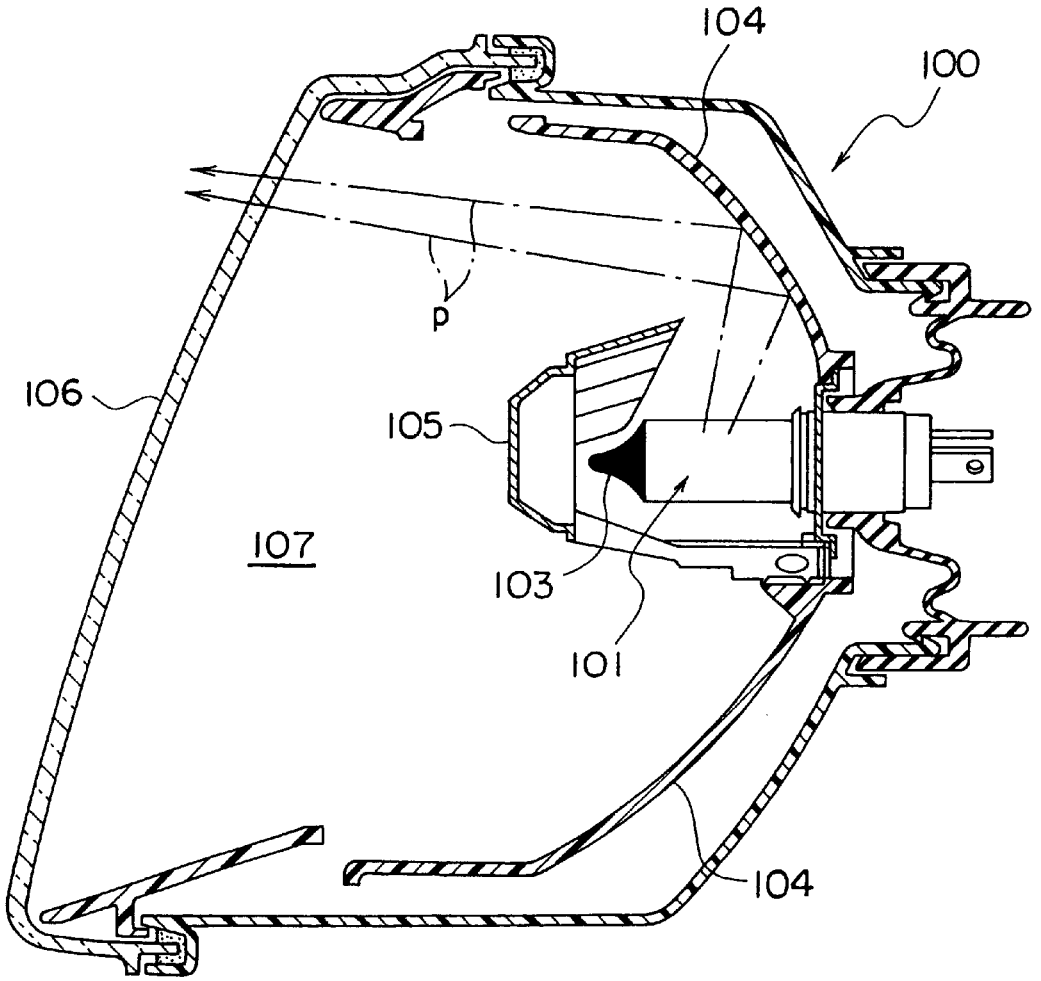
FIG. 6 is a cross-sectional view of a vehicular lighting fixture that has a shade equipped with a conventional glare-protection-paint-applied bulb.

Thus, in prior art, a shade member (see the reference numeral 105 shown in FIG. 6) of a silver color which is the same color as that of the reflector is installed so as to cover the top portion of the bulb. However, since the shade member is additionally required, the number of parts increases, and this constitutes a factor of increasing costs.

Hence, the inventors of the present application changed the fundamental concept of the conventional art so as to dispense with the shade member by using a glare-protection paint having a color that is the same color group as that of the reflector and made strenuous studies to find a glare-protection paint that is satisfactory in glare-protection performance, durability and the like. As a result, the inventors found that a glare-protection paint that has compositions (substances) of Type I or II described below is especially preferable.

Compositions (Substances) of Type I

As a tinting substance, silicon carbide (SiC) of a white color group is employed. The silicon carbide is compounded with a black calcined pigment A at a ratio of 4 to 1. The black calcined pigment A is composed of copper (Cii), iron (Fe) and manganese (Mn). The silicon carbide thus compounded with the black calcined pigment A is blended with bentonite (a thickening agent) and silica-type varnish.

As shown in FIG. 4, the paint of Type I has the following ratio of composition: 28 weight % of silicon carbide, 7 weight % of black calcined pigment, A, 3 weight % of bentonite, and 62 weight % of silica-type varnish.

Compositions (Substances) of Type II

As a tinting substance, silicon carbide is employed as in Type I. In Type II, however, the silicon carbide is compounded with a black calcined pigment B at a ratio of 7 to 3. The black calcined pigment B is an inorganic pigment composed only of silicon. The silicon carbide thus compounded with the black calcined pigment B is mixed with bentonite (a thickening agent) and silica-type varnish.

As shown in FIG. 4, the paint of Type II has the following ratio of composition: 28 weight % of silicon carbide, 12 weight, % of black calcined pigment B, 2 weight % of bentonite, and 58 weight; % of silica-type varnish.

The paint of Type II employs the inorganic pigment that is composed of silicon only. Accordingly, metals are completely eliminated from the inorganic pigment. Thus, the paint of Type II is more environment-friendly.

In the above-described glare-protection paints of Type I and Type II, silicon carbide is employed as a tinting substance of a white color group. The reason for this as follows: By compounding silicon carbide with black calcined pigment A or B, it becomes possible to obtain a gray color which is close to a color of aluminum evaporation of the reflector 5. Since the silicon carbide has a crystal structure in which silicon and carbon are covalently linked at a ratio of 1:1, the silicon carbide has hardness and heat resistance that exceed those of alumina and silicon nitride. Also, the silicon carbide is high in corrosion resistance and thus can inhibit the bulb from being discolored or damaged by heat.

By compounding the silicon carbide with the black calcined pigment A or B, the glare-protection paint 3 of the present invention (both Type I and II) has a color tone of beautiful gray within the range of YN-50 to YN-60 described in the JIS Standard Color Chart (JIS 8721). This color tone is equivalent to a Munsell value of N (achromatic color) 5 to 6. Because this color tone is not too close to either black or white and can exert the effect of protective coloration for the color of the reflector 5, it is highly desirable.

Munsell value, which is one of color-expressing systems generally used in the circle of paint and painting, is determined by a color system standardized according to shade, brightness and saturation, which constitute three attributes of color sensation. Meanwhile, conventional glare-protection-paint-applied bulb of black top type has a Munsell value of N1 (black). Color white is denoted by N9 in Munsell value.

According to experiments conducted by the inventors of the present application, as long as the glare-protection paint 3 has a gray color which is within a range of YN-50 to YN-80 in the JIS Standard Color Chart (JIS 8721) and within the range of Munsell values N (achromatic color) 5 to 8, it is permissible in terms of external appearance.

In experiments conducted in regards to blending of compositions of Type I and Type II paints, aluminum or titanium dioxide was added to the paint substances in order to obtain a silver color. The experiments, however, indicate that when aluminum or titanium dioxide is added, the paint substances are discolored at a high temperature and become close to a black color group. Thus, paints mixed with aluminum or titanium dioxide is inappropriate as the glare-protection paint 3.

The black calcined pigment A used in Type I paint and the black calcined pigment B used in Type II paint are both composed of substances that do not contain chrome or lead. Therefore, the paint (Type I and Type II) of the present invention does not cause any environmental pollution and are thus preferable.

It is preferable that silicon carbide is contained by 20 to 30 weight % in the glare-protection paint 3. If silicon carbide is less than 20 weight % in the paint, durability of a paint film derived from silicon carbide decreases, and the film becomes vulnerable to damage. On the other hand, if silicon carbide exceeds 30 weight %, adhesion properties of the glare-protection paint 3 on the surface of the glass tube la deteriorate. This is because the amount of bentonite in the paint substances needs to be maintained at 2 to 3 weight %, and this inevitably requires a blending adjustment with a reduced amount of varnish substances.

Quality tests were conducted on the bulbs on which the above-described glare-protection paint 3 of Type I or II applied on the top portions 2 thereof. Truly excellent results were obtained, and a description of the tests will be presented below.

(1) External Appearance Tests

Visual confirmations of the bulbs under diffused daylight indicated no abnormalities.

Visual confirmations were further conducted on the bulbs after they were lit at 14V for one minute and dried at 650° C. for 180 seconds. No abnormality such as "lack of hiding" or "bubble" was observed.

(2) Adhesion Property Tests on the Glass Tube 1*a*

One hundred grids of 1 $mm^2$ reaching the glass surface of the bulbs were formed on the paint films, and a cellophane tape of 24 mm width was thoroughly attached on the grids of each one of the bulbs. Then the cellophane tape was abruptly peeled off in the direction of 45°. The experiment did not confirm any detachment of the paint films.

Bulbs with the glare-protection paint 3 of Type I or II applied on the top portions 2 thereof were left in an environment of 650° C. for two hours, a room temperature for 0.5 hours, 30° C. for two hours and a room temperature for 0.5 hours. This cycle was repeated for three times, and then the tests of adhesion properties as described above were conducted. The result indicates no detachment of the paint. Thus, it is determined that the bulbs 1 have no problem as to their resistance against thermal shock.

(3) Hardness Tests

Bulbs 1 were lit for two hours. Then, a pencil (Mitsubishi "High-Unit" pencil) HB was pressed against paint at an angle of 45° and displaced forwards by approximately 1 mm with such a strength as not to break the lead. No peeling or damage was observed in the paint of the respective bulbs.

(4) Heat Resistance Tests

Bulbs were left at 650° C. for 1000 hours and then left at a room temperature for an hour. The tests of external appearance and adhesion properties were conducted as in the same manner as described above on these bulbs 1. No peeling or damage was observed in the paint of either bulb.

(5) Adhesion Property and Humidity Resistance Tests

Wrapped bulbs 1 were left in a bath at a temperature of 50° C. and a humidity of 95% for 240 hours, and the tests of external appearance and adhesion properties were conducted. No peeling or damage was observed in the paint.

(6) Accelerated Weathering Tests

Bulbs 1 were irradiated with ultraviolet rays for 240 hours, and the tests of external appearance and adhesion properties were conducted. No peeling or damage was observed in the paint.

(7) Cohesiveness Tests

Bulbs 1 were disposed in a high-temperature bath of 70° C. Five layered of gauze were laid thereon, a weight of 500 g was placed thereon, and the bulbs 1 were left for two hours. Furthermore, the bulbs were left for one hour at a room temperature. The external appearance tests were conducted on the bulb. The result showed no cloth mark from the gauze on the films.

(8) Glass Haziness

Bulb 1 was put in a glass container, and the container is closed with a glass plate. The bulbs were lit at 13.2V for one hour, and haziness of the glass plate was measured. The glass plate had no haze thereon and thus caused no problem at all.

As seen from the above test results, it is clear that the glare-protection-paint-applied bulb and a vehicular lighting fixture equipped therewith according to the present invention are excellent for practical use.

According to the invention, silicon carbide of a white color group is used in the glare-protection-paint-applied bulb; as a result, the paint can assume a color that is close to a silver color (a color of aluminum evaporation) of reflectors. Therefore, even if no shade member for covering the bulb is used, it is difficult to visually recognize the bulb from the outside. Therefore, it is possible to reduce the number of parts and cut down the costs.

The crystal structure of the silicon carbide is such that silicon and carbon are covalently linked at a ratio of 1:1. Accordingly, such a silicon carbide used as a paint substance has hardness and heat resistance that are higher than those of alumina and silicon nitride. Also, the silicon carbide is high in corrosion resistance and thus serves to prevent the bulb from being discolored or damaged by heat. Therefore, it is possible to provide a high-quality glare-protection-paint-applied bulb.

Furthermore, in the present invention, a predetermined amount of a black calcined pigment is compounded with silicon carbide of a white color group. Thus, it becomes possible not only to easily achieve harmonization in the form of protective coloration for a silver color of the aluminum-evaporated surface of a reflector disposed around the bulb but also to compensate for relatively low glare-protection performance of silicon carbide by the black calcined pigment. It is, therefore, possible to acquire balance in color tone and glare-protection performance.

In the present invention, an inorganic pigment; composed of copper (Cu), iron (Fe) and manganese (Mn) is employed as a black calcined pigment. In other words, substances such as chrome and lead, which threaten to cause environmental pollution, are not used in the paint of the present invention.

With an employment of an inorganic pigment composed only of silicon as a black calcined pigment, it is possible to remove all metals from the inorganic pigment. This is more favorable in terms of environment-friendliness.

With the use of glare-protection paint that contains 20 to 30 weight % of silicon carbide, visual confirmation from the outside indicates that the glare-protection paint can assume a desired gray color as long as the black calcined pigments as described above is contained in the paint.

Furthermore, in a vehicular lighting fixture according to the present invention that is equipped with the glare-protection-paint-applied bulb as described above, it is difficult to visually recognize (a top portion of) the bulb installed in a light chamber even though the front lens of the lighting fixture is transparent. Therefore, the lighting fixture of the present invention is aesthetically appropriate, demonstrates high durability, and causes no problem of environmental pollution in the process of manufacture and abandonment thereof.

As seen from the above, the glare-protection-paint-applied bulb and a vehicular lighting fixture equipped therewith according to the invention make it possible to improve external appearance of the lighting fixture, cut down the costs and promote environment-friendliness. The present invention greatly contributes to the development of industries engaged in the manufacture of vehicular lighting fixtures and to the development of automobile-related industries.

What is claimed is:

1. A vehicular bulb with glare-protection-paint applied to a portion of a vehicular bulb, said paint comprising silicon carbide (SiC) contained in a pigment of the glare-protection paint for being applied on a portion of a glass tube of said vehicular bulb.

2. The bulb according to claim 1, wherein said glare-protection paint externally assumes a gray color defined by a range of YN-50 to YN-80 in JIS Standard Color Chart (JIS 8721) by compounding a predetermined amount of a black calcined pigment with said pigment.

3. The bulb according to claim 2, wherein said black calcined pigment is an inorganic pigment composed of copper (Cu), iron (Fe) and manganese (Mn).

4. The bulb according to claim 2, wherein said black calcined pigment is an inorganic pigment composed of silicon (Si).

5. The bulb according to any one of claims 1 through 4, wherein 20 to 30 weight % of said silicon carbide is contained in said glare-protection paint.

6. A vehicular lighting fixture equipped with a bulb on which a glare-protection paint is partially applied, wherein said glare-protection paint includes a pigment containing silicon carbide (SiC) therein.

7. The vehicular lighting fixture according to claim 6, wherein said glare-protection paint externally assumes a gray color defined by a range of YN-50 to YN-80 in JIS Standard Color Chart (JIS 8721) by compounding a predetermined amount of a black calcined pigment with said pigment.

8. The vehicular lighting fixture according to claim 7, wherein said black calcined pigment is an inorganic pigment composed of copper (Cu), iron (Fe) and manganese (Mn).

9. The vehicular lighting fixture according to claim 7, wherein said black calcined pigment is an inorganic pigment composed of silicon (Si).

10. The vehicular lighting fixture according to any one of claim 5 through 9, wherein 20 to 30 weight % of said silicon carbide is contained in said glare-protection paint.

* * * * *